US005584563A

United States Patent [19]

Stottmann

[11] Patent Number: 5,584,563

[45] Date of Patent: Dec. 17, 1996

[54] APPLIANCE CONTROL ASSEMBLY

[75] Inventor: Richard L. Stottmann, Harrods Creek, Ky.

[73] Assignee: General Electric Company, Louisville, Ky.

[21] Appl. No.: 585,063

[22] Filed: Jan. 16, 1996

[51] Int. Cl.[6] ..... F21V 33/00

[52] U.S. Cl. ..... 362/85; 362/328; 116/DIG. 28; 200/DIG. 47

[58] Field of Search ..... 116/279, DIG. 28; 200/314, DIG. 47; 362/85, 95, 89, 328, 253

[56] References Cited

U.S. PATENT DOCUMENTS

| | | | |
|---|---|---|---|
| 2,285,374 | 6/1942 | Dohsmann et al. | 116/124.1 |
| 3,163,739 | 12/1964 | Hutt | 200/167 |
| 3,169,506 | 2/1965 | Morris | 116/124.4 |
| 3,213,269 | 10/1965 | Melvin et al. | 240/1 |
| 5,128,842 | 7/1992 | Kenmochi | 362/95 |

*Primary Examiner*—Stephen F. Husar
*Attorney, Agent, or Firm*—H. Neil Houser

[57] ABSTRACT

An appliance control assembly includes an escutcheon assembly to support controls for the appliance. A push button switch mechanism includes a row of push buttons, each having an extended and a depressed position. The switch mechanism also includes a row of indicator flags integral with the push buttons for movement therewith. The escutcheon assembly includes a row of light ports positioned to be exposed to ambient light and adapted to pass ambient light through the escutcheon assembly. The switch mechanism further includes a row of prisms positioned adjacent the row of push buttons. The switch mechanism is mounted to the escutcheon assembly with the prisms aligned with the light ports to direct toward the indicator flags ambient light received through the light ports and to direct toward the light ports light reflected by the indicator flags. Each indicator flag has a reflective surface positioned to reflect ambient light received from the corresponding prism only when the corresponding push button is in its depressed position.

6 Claims, 2 Drawing Sheets

10
11
12
13
14
15
16
17
20
21
22
23
24
26
28
29
30
31
32
33
46
47
48
3

APPLIANCE CONTROL ASSEMBLY

BACKGROUND OF THE INVENTION

The present invention relates to major household appliance, such as dish washers, clothes washers and clothes dryers for example. More particularly it relates to an improved control assembly for such appliances. It is very desirable to indicate to the user which cycle or mode of operation has been selected. In prior machines with push buttons or rotary controls that protrude from the front of the escutcheon assembly this was accomplished by the depressed position of the actuated push button or the angular position of the rotary control. It also can be accomplished with indicator lights at significant added cost.

Many present day major appliances use mechanical push button switch controls overlaid by a flexible cover sheet which is depressed to actuate individual push buttons. Such control assemblies provide the appearance and feel of electronic controls at a lower cost. With such control assemblies the user cannot see which push button is depressed. In addition, in order to reliably actuate the push buttons through the flexible cover sheet, push button mechanisms have been improved so the push buttons have a very short travel between their extended and depressed positions, often on the order of about 0.06 inch. This short travel makes it very difficult to actuate a mechanical system to indicate the push button position.

Switch mechanisms have been known for years which include various arrangements to provide a light adjacent a switch for indicating that the switch is in a particular position or condition. Such arrangements normally include an internal light source and a prism and reflector system for directing a portion of the light to a particular lens or opening when the switch is in a particular position. Such systems are complicated and expensive. In addition the internal light source normally has a life much shorter then the switch and must be replaced from time to time.

The users of major household appliances normally manipulate the controls and check on the status of the appliance only when there is an appreciable level of ambient light present, that is either during daylight or with the room lighting on. The present invention takes advantage of this fact to provide a simplified control assembly that uses ambient light to indicate to the user the status of the control switch mechanism.

It is an object of the present invention to provide an improved appliance control assembly that indicates to the user the status of the controls.

It is another object of the present invention to provide such an improved control assembly that utilizes reflected ambient light to illuminate a light port when an associated switch actuator is in a predetermined condition.

SUMMARY OF THE INVENTION

In accordance with one embodiment of the present invention an appliance control assembly includes an escutcheon adapted to support controls for the appliance and a slot is formed in the escutcheon. A push button switch mechanism includes a plurality of push buttons arranged in a row and each push button has an extended and a depressed position. The switch mechanism also includes a plurality of indicator flags arranged in a row with each flag being moveable with a corresponding push button. The switch mechanism further includes a plurality of prisms arranged in a row, with each prism being positioned adjacent a corresponding push button. The switch assembly is mounted on the inner side of the escutcheon with the push buttons, indicator flags and prisms received in the slot. A cover includes a plurality of touch pads arranged in a row and a plurality of light ports arranged in a row with each light port positioned adjacent a corresponding touch pad. The light ports are adapted to pass light through the cover. The cover is mounted over the outer side of the escutcheon and overlies the slot with each touch pad aligned with a corresponding push button and with each light port aligned with a corresponding prism. Each prism is adapted to direct toward the corresponding indicator flag ambient light passing through the corresponding light port and to direct outward the corresponding light port light reflected by the corresponding indicator flag. Each indicator flag includes a reflective surface positioned to reflect light received from the corresponding prism only when the corresponding push button is in its depressed position.

BRIEF DESCRIPTION OF THE DRAWINGS

While features of the invention presently considered to be novel are set forth in the appended claims; the invention, both as to organization and content, will be better understood and appreciated from the following detailed description, taken in conjunction with the accompanying drawings, in which:

DETAILED DESCRIPTION OF PREFERRED EMBODIMENTS

Figures 1, 2:
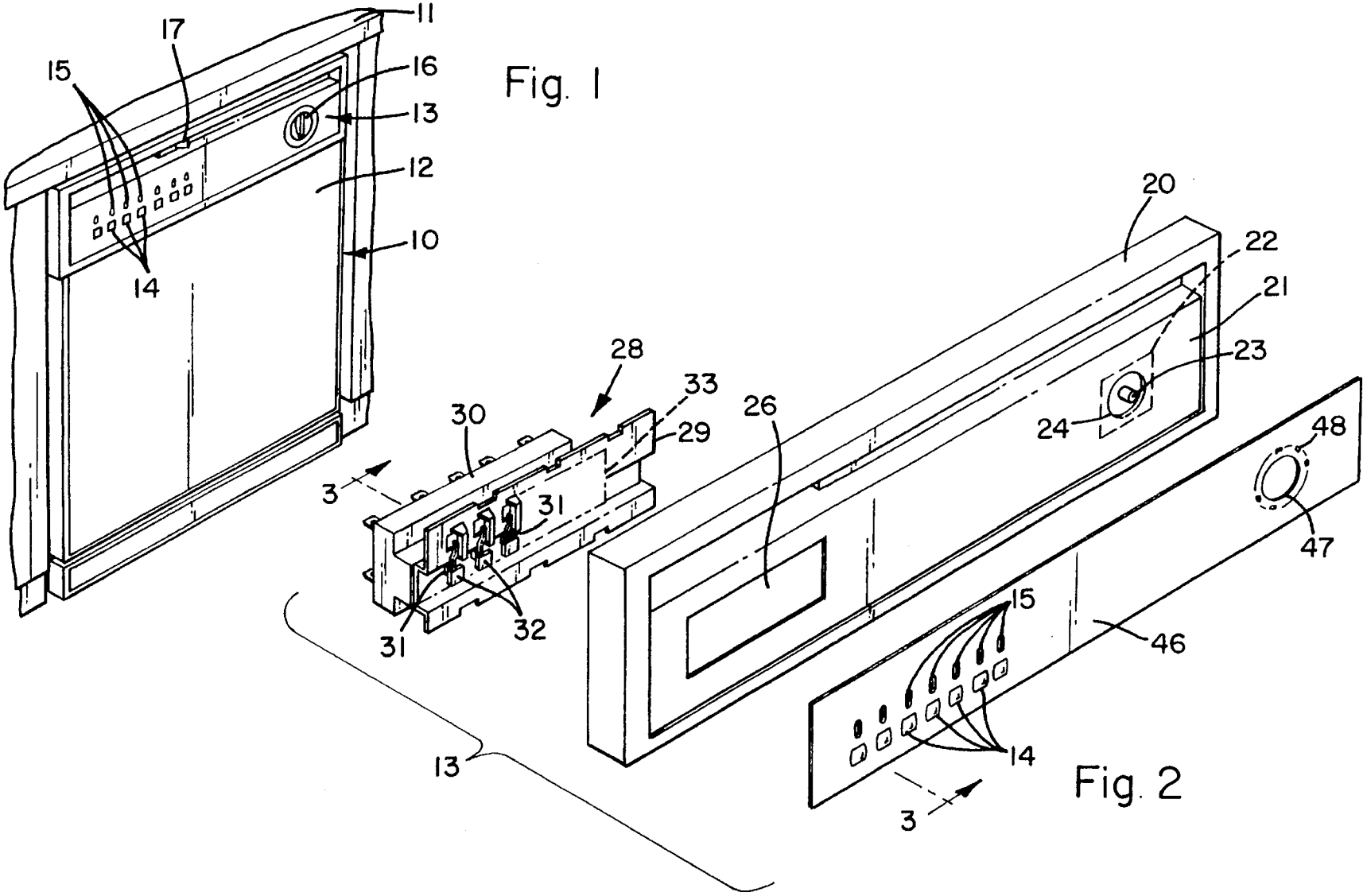
FIG. 1 is a front perspective view of a built-in dishwasher, illustrating the placement of the control assembly.
FIG. 2 is a partial exploded view of major components of the control assembly.

Referring now to FIG. 1, there is illustrated a dishwasher 10 built into a kitchen cabinet unit 11. More particularly, the dishwasher door 12 includes an integral control assembly 13, which includes push button actuating touch pads 14, light ports 15 and a control knob 16. The touch pads 14 and rotatable knob 16 are used to select the desired cycle of operation of the dishwasher and other operating parameters. As will be discussed in detail hereafter, the light ports are used to inform the user which options have been selected by depression of a touch pad. A handle 17 extends through the upper portion of the control assembly and is used to selectively lock the door 12 in its closed position so that it will not inadvertently be opened while the machine is operating.

FIG. 2 illustrates, in somewhat simplified form, certain major components of the control assembly. An escutcheon 20, formed from a suitable molded plastic material, is an integral part of the door assembly 12 and provides support for the other components of the of the control assembly. The escutcheon 20 includes a planar base plate 21. A control 22 is mounted on the inner side of the base plate 21 and includes a rotatable shaft 23 projecting through a circular opening 24 in the base plate. The control knob 16 mounts on the shaft 23 and is used to set the control 22 by rotating the shaft 23. Conveniently the control 22 may be a timer mechanism. An elongated, generally rectangular slot 26 is formed near the opposite end of the base plate 21. As will be described in detail hereafter, push buttons, indicator flags and prisms of a push button actuated mechanical switch mechanism 28 extend through the slot 26.

A switch mechanism 28 includes a mounting bracket 29 which supports a switch slide and contact module 30. Actuating rods 31 extend from the front of the module 30 and project through openings in the bracket 29. A push button 32 is mounted on the distal end of each rod 31. Push button type switch mechanisms have been well known in the art for many years. In such mechanisms, depressing a push button 32 moves the associated rod 31 into the module to actuate one or more selected contact pairs therein. When one push button is depressed its rod moves slides in the module to releasably lock that rod and push button pair in its depressed position and normally to force at least one previously depressed button and rod pair outward to its extended position. In addition, many switch mechanisms include springs which bias the rods to their outward, extended, positions. The internal workings of the push button actuated switch mechanism do not form a part of the present invention and have been omitted for the sake of simplicity.

Figure 6:
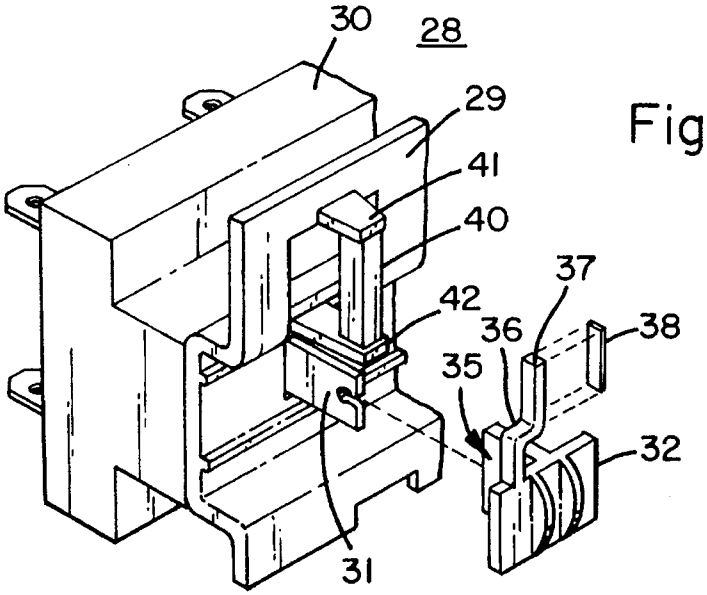
FIG. 6 is an enlarged fragmentary perspective view of the push button switch mechanism seen in FIGS. 2–5.

In the exemplification control assembly a plurality of push buttons 32 are arranged in a row along the bracket 29. While three push buttons have been shown for illustration, it will be understood that push buttons generally are spaced apart along the entire length of module 30, as indicated by dashed line rectangle 33. The number of push buttons included in the switch mechanism for a particular appliance will be determined by the number of separate push button operations needed to provide for all the functions or cycles of the appliance. Referring particularly to FIG. 6, each push button 32 includes an integral indicator flag 35 that extends upward from the button 32 and is off set inward at 36 to form a vertical face portion 37 positioned just slightly off the center of the button 32. The face 37 is provided with a highly light reflective surface by means of a reflective overlay 38 that is attached to the face 37. It will be understood that other approaches can be followed to provide the reflective surface. For example, the face 37 could be covered with a reflective paint or other coating or the flag could be molded from a material having high light reflective properties.

Figure 5:
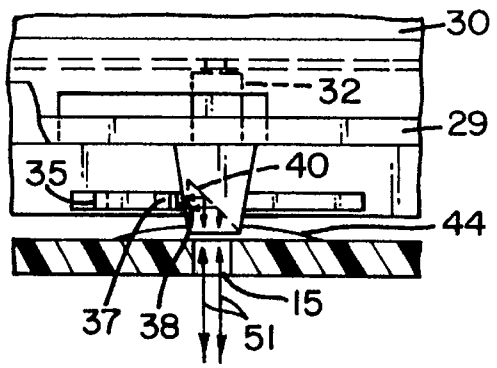
FIG. 5 is a cross section view as seen in FIG. 4 but with the push button and rod pair in its depressed position.
Figure 4:
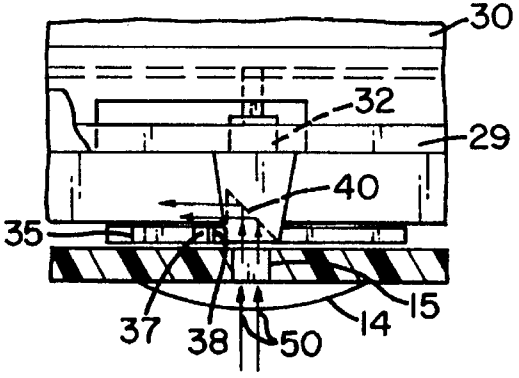
FIG. 4 is a cross section view as seen along line 4—4 in FIG. 3, illustrating a push button and rod pair in its extended position.

A light prism 40 is mounted above and in alignment with the center of each push button and rod pair by upper and lower tabs 41,42. The prisms 40 are constructed and positioned to receive light traveling perpendicular to the front of the switch mechanism and redirect it to the left (as seen in FIGS. 4–6) toward the reflective surface of face 37 and to receive light reflected from the face 37 and redirect it perpendicularly away from the switch mechanism.

Figure 3:
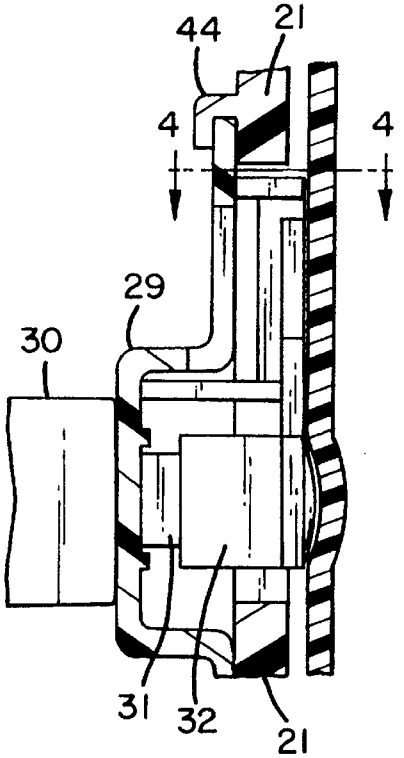
FIG. 3 is a cross section view of the control assembly generally as seen along line 3—3 in FIG. 2, but with the assembly in its assembled configuration.

The switch mechanism 28 is mounted on the inner side of escutcheon 20, that is on the rear of base plate 21 as seen in FIGS. 2–6, by means of brackets formed on the rear of the plate 21, one of which is shown at 44 in FIG. 3. The push buttons 32, indicator flags 35 and prisms 40 and extend through the slot 26 in face plate 21.

A cover 46 is mounted on the face plate 21 and overlies the slot 26 so as to cover the push buttons 32, indicator flags 35 and prisms 40. Conveniently the cover can be mechanically mounted over the front of the face plate 21 as by a channel extending around the inner edge of escutcheon 20 so as to be easily removable. If desired the cover can be more permanently mounted on the face plate 21 by a suitable adhesive. In either event the cover conveniently can be considered a part of the escutcheon or control panel assembly. The row of touch pads 14 are formed as small flexible areas in the cover 46 and each pad is aligned with a corresponding push buttons 32. The light ports 15 are formed as small clear areas in the cover 46 and each light port 15 is aligned with a corresponding prism 40. Conveniently the light ports 15 have the same cross section shape as the facing portions of the prisms. Suitable indicia (not shown) can be included above each light port to inform the user of the purpose of the associated push button. A circular opening 47 receives the shaft 23 and indicia 48 are provided around the opening to inform the user of significance of various rotary positions of the shaft 23 and knob 16.

Conveniently the cover 46 can be formed as a sheet of suitable plastic material such as, for example, the polycarbonate material sold by General Electric Company under the name LEXAN. In the illustrative embodiment the cover is made opaque by silk screening an opaque coating or paint on the inner side of the sheet. In that event various indicia and other graphic elements, as desired, are silk screened on the sheet before the opaque layer of coating or paint is applied. However, other approaches, such as a separate, opaque liner for example, can be used. In any event, the light ports 15 are transparent and pass or transmit light through the cover 46. Conveniently, in the illustrative embodiment the light ports are formed by omitting the opaque coating from small areas of the sheet. In any event, when the light ports are exposed to the ambient light present in the area in which the appliance is installed, they will pass a portion of the ambient light through the cover 46.

FIG. 4 illustrates one of the push button 32 and rod 31 pairs in its outer or extended position and FIG. 5 illustrates the same pair in its inner or depressed position. As shown by arrows 50 in FIG. 4, the prism 40 receives ambient light passed or transmitted through the cover 46 by light port 15 and redirects that ambient light toward face portion 37 of indicator flag 35. However, as seen in FIG. 4, the reflective surface 38 of face portion 37 is not aligned with prism 40 when the push button 32 is in its extended position and the light from prism 40 misses the face portion. Thus no light is reflected back through the light port, which appears to the user to be dark or not illuminated. The path of this ambient light is illustrated by arrows 50 in FIG. 4.

In FIG. 5 the prism 40 receives light passed through cover 46 by light port 15 and redirects the ambient light toward reflective face 37. The reflective surface 38 of face portion 37 is aligned with prism 40 when the push button 32 is in its inner or depressed position. Thus, light from prism 40 impinges the face portion 37 and is reflected back to the prism 40 which redirects it back through the light port 15 so that the light port appears bright and illuminated. This complete path of the ambient light is shown by arrows 51 in FIG. 5.

While the invention has been illustrated in the embodiment of a dishwasher, it will be understood that the invention is applicable to other machines, particularly to other major household appliances that normally are operated in lighted areas. All the light ports will be dark or non-illuminated when the appliance is in an unlighted atmosphere. However, this does not present a problem as consumers normally do not try to set or check on the setting of such appliances in dark rooms. If there is not sufficient natural light in the room, they will turn on a light before using the appliance.

While specific embodiments of the invention have been illustrated and described herein, it is realized that modifications and changes will occur to those skilled in the art to which the invention pertains. It is therefore to be understood that the appended claims are intended to cover all such modifications and changes as fall within the true spirit and scope of the invention.

What is claimed is:

1. An appliance control assembly, including:

an escutcheon assembly adapted to support controls for said appliance;

a push button switch mechanism including a row of push buttons, each of said push buttons having an extended position and a depressed position; said push button assembly also including a row of indicator flags, each indicator flag being movable with a corresponding push button between the extended and depressed positions of that push button;

said escutcheon assembly including a row of light ports positioned to be exposed to ambient light and adapted to pass light through said escutcheon;

said push button switch assembly also including a row of prisms, each prism being positioned adjacent a corresponding push button; said push button assembly being mounted to said escutcheon assembly with each prism aligned with a corresponding light port;

each prism being adapted to direct ambient light received through the corresponding light port toward the corresponding indicator flag and to direct light reflected by the corresponding indicator flag toward the corresponding light port; and each indicator flag including a reflective surface positioned to reflect ambient light received from the corresponding prism only when the corresponding push button is in its depressed position.

2. An appliance control assembly as set forth in claim 1, wherein: said escutcheon assembly includes an opaque area surrounding said row of light ports.

3. An appliance control assembly as set forth in claim 1, wherein: each indicator flag is integral with the corresponding push button.

4. An appliance control assembly, including:

an escutcheon adapted to support controls for said appliance and including a slot;

a push button switch mechanism including a plurality of push buttons arranged in a row, each of said push buttons having an extended position and a depressed position; said switch mechanism also including a plurality of indicator flags arranged in a row, each indicator flag being movable with a corresponding push button between the extended and depressed positions of that push button; said switch mechanism also including a plurality of prisms arranged in a row with each prism positioned adjacent to a corresponding push button;

said switch assembly being mounted on the inner side of said escutcheon with said push buttons, said indicator flags and said prisms aligned with said escutcheon slot;

a cover including a plurality of touch pads arranged in a row and a plurality of light ports arranged in a row with each light port positioned adjacent a corresponding touch pad, each of said light ports being adapted to pass light through said cover; said cover being mounted over the outer side of said escutcheon and overlying said slot with each touch pad aligned with a corresponding push button and with each light port aligned with a corresponding prism;

each prism being adapted to direct toward the corresponding indicator flag ambient light passing through the corresponding light port and to direct toward the corresponding light port light reflected by the corresponding indicator flag;

each indicator flag including a reflective surface positioned to reflect ambient light received from the corresponding prism only when the corresponding push button is in a predetermined one of its position.

5. An appliance control assembly as set forth in claim 4, wherein: each indicator flag is integral with the corresponding push button.

6. An appliance control assembly as set forth in claim 4, wherein: the portion of said cover overlying said slot is opaque and each of said light ports is a clear area therein.

* * * * *